US005949321A

United States Patent [19]

Grandmont et al.

[11] Patent Number: 5,949,321

[45] Date of Patent: Sep. 7, 1999

[54] PLANAR TRANSFORMER

[75] Inventors: Paul E. Grandmont, Whitman; Qun Lu, Lexington; Fei Ma, Malden, all of Mass.

[73] Assignee: International Power Devices, Inc., Allston, Mass.

[ * ] Notice: This patent is subject to a terminal disclaimer.

[21] Appl. No.: 09/114,759

[22] Filed: Jul. 14, 1998

Related U.S. Application Data

[62] Division of application No. 08/693,878, Aug. 5, 1996, Pat. No. 5,781,093.

[51] Int. Cl.[6] ..... H01F 5/00; H01F 27/28

[52] U.S. Cl. ..... 336/232; 336/200

[58] Field of Search ..... 336/200, 232, 336/183

[56] References Cited

U.S. PATENT DOCUMENTS

| | | | |
|---|---|---|---|
| 5,202,752 | 4/1993 | Honjo | 257/678 |
| 5,386,206 | 1/1995 | Iwantani et al. | 336/200 |
| 5,402,098 | 3/1995 | Ohta et al. | 336/200 |
| 5,515,022 | 5/1996 | Tashiro et al. | 336/200 |

FOREIGN PATENT DOCUMENTS

| | | | |
|---|---|---|---|
| 514136 | 11/1992 | European Pat. Off. | 336/200 |
| 5-6829 | 1/1993 | Japan | 336/200 |

OTHER PUBLICATIONS

Dai, et al., "A Comparative Study of High–Frequency, Low–Profile Planar Transformer Technologies," *Proceedings of the Applied Power Electronics Conference*: Orlando, Florida (Feb. 15, 1994) pp. 226–232.

*Primary Examiner*—Michael L. Gellner
*Assistant Examiner*—Anh Mai
*Attorney, Agent, or Firm*—Fish & Richardson P.C.

[57] ABSTRACT

A planar winding assembly includes first and second windings, each winding having an axis and a pair of insulative sheet layers, laminated together, with at least one of each of the pairs of insulative sheets having a hole. Each winding further includes a metal strip conductor that is wound about the axis of its winding and is sealed between the laminated insulative sheet layers. The metal strip conductor has a portion projecting into the hole. The metal strip conductor of the first winding is electrically connected to the metal strip conductor of the second winding through the holes of the insulative sheets.

16 Claims, 8 Drawing Sheets

PLANAR TRANSFORMER

CROSS REFERENCE TO RELATED APPLICATION

Under 35 USC §120, this application is a division of prior U.S. serial application Ser. No. 08/693,878, filed Aug. 5, 1996. U.S. Pat. No. 5,781,093

BACKGROUND OF THE INVENTION

The invention relates to high power planar transformers.

Efforts to reduce the size of power supplies and DC-DC converters is ongoing. Magnetic transformer and inductor components are an important class of components used in these power supplies and are generally the most difficult to miniaturize. Recently, so called "planar magnetic components" (e.g., transformers and inductors) with low-profiles including those fabricated with flexible circuit and multilayer printed circuit board (PCB) technologies are being used in applications where space is limited.

SUMMARY OF THE INVENTION

In one aspect of the invention, a planar winding assembly includes first and second windings, each winding having an axis and a pair of insulative sheet layers which are laminated together, with at least one of each of the pairs of insulative sheets having a hole. Each winding further includes a metal strip conductor that is wound about the axis of its winding and is sealed between the laminated insulative sheet layers. The metal strip conductor has a portion projecting into the hole. The metal strip conductor of the first winding is electrically interconnected (e.g., soldered) to the metal strip conductor of the second winding through the holes of the insulative sheets.

This invention provides a relatively small, low-profile transformer capable of handling high power (e.g., greater than 150 watts) and having a high isolation voltage (e.g., greater than 6,000 volts). Moreover, the transformer is highly reliable and can be operated over a wide temperature range.

Embodiments of the invention may include one or more of the following features. The first winding is a multiple turn winding. The first and second windings are adhesively bonded together. Each of the metal strip conductors may be formed on a lead frame element. The insulative sheet members are polyimide and the metal strip conductors are copper.

In a transformer embodiment, the planar winding assembly further includes a third winding disposed between the first and second windings and having a metal strip conductor. The first and second windings are interconnected to provide a primary of a planar transformer with the third winding providing a secondary of the transformer.

In preferred embodiments of this transformer, at least one of each of the pairs of insulative sheets of each of the first, second and third windings includes a hole. The holes formed in the first and second windings exposes a portion of the metal strip conductor associated with the insulator sheet having the hole so that the electrical connection of the metal strip conductors can be made through the holes of the first, second and third windings. The first, second and third windings are adhesively bonded together.

The holes provide a convenient way of electrically interconnecting the first and second windings which are generally multiple-turn planar windings and have been individually sealed between laminated insulative sheets. The first and second windings, for example, may form a primary winding of a transformer with the third winding being a secondary winding symmetrically positioned between each half of the primary. The third winding is not electrically interconnected to either the first or second winding. However, the hole formed in the third winding allows the first and second windings to be electrically interconnected therethrough. This advantages of this approach for interconnecting individually sealed windings are numerous. The interconnection approach of the invention allows the use of multiple-turn planar configurations. The relatively thick metal strip conductors are laminated between a pair of relatively thin insulative sheets windings to ensure high voltage isolation between the windings as well as a highly reliable seal even when the windings are operated at high temperatures (e.g., as high as 120° C.). Moreover, the assemblies (e.g., circuit boards) within which the transformers are used, are often exposed to high pressure "water-washing" processes. The windings are individually-sealed to ensure that they are moisture impervious during such cleaning procedures.

Further, the windings can be fabricated and sealed in a highly repeatable manufacturing process. Individually sealing each winding also allows the windings to be combined to provide a wide variety of transformers or other magnetic coil component configurations. That is, a large number of transformers or magnetic coil components may be constructed from a limited number of winding configurations simply by stacking and interconnecting the windings in different ways. Moreover, because the windings are individually sealed, the adhesive used in bonding the windings together need not be relied upon to provide a moisture impervious seal of the windings.

The transformer embodiment may further include a ferrite core member with the insulative sheet members of the first and second windings having an aperture sized to receive the ferrite core member.

Other features and advantages of the invention will be apparent from the following description of the preferred embodiments and from the claims.

DESCRIPTION OF THE PREFERRED EMBODIMENTS

Figure 4A:
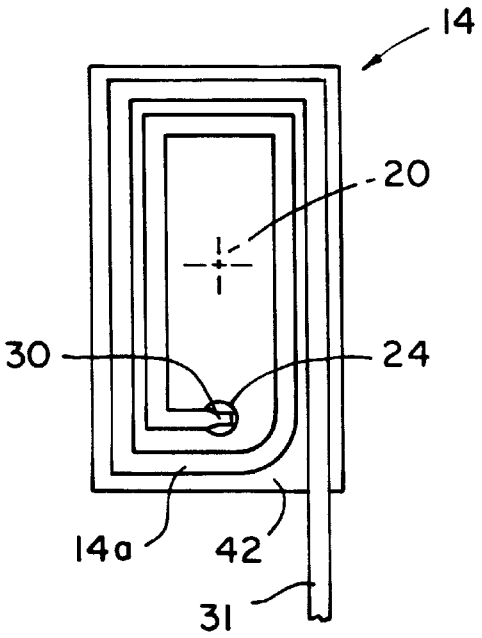
FIGS. 4A–4C are plan views of the winding elements of the planar transformer of FIG. 1.
Figure 4B:
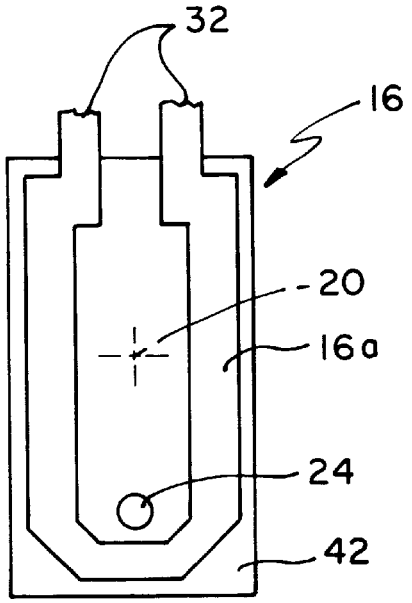
Figure 4C:
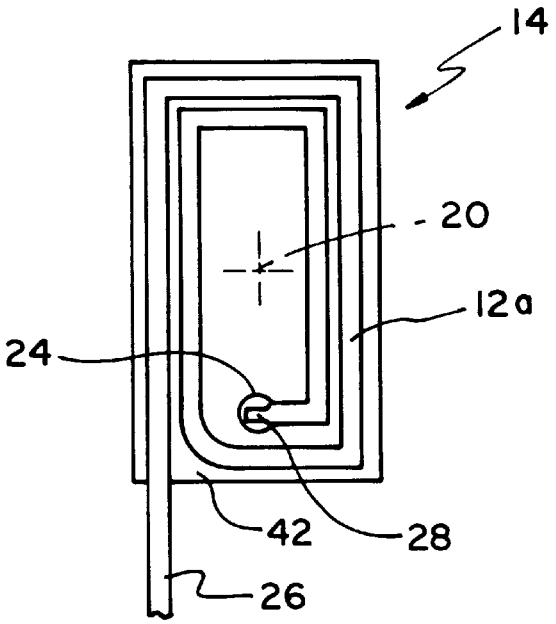

Referring to FIGS. 1–3 and 4*a*–4*c*, a high-power planar transformer 10 capable of handling 150 watts while providing isolation voltages greater than 6,000 volts is shown. Moreover, transformer 10 has a relatively small overall outer dimension. In particular, the transformer has a lead-to-lead length of approximately 1.25 inches , a width of 0.75 inches and a depth of 0.30 inches . Transformer 10 includes a primary winding consisting of a pair of winding elements 12, 14 and a secondary winding 16 positioned therebetween. Winding elements 12, 14, 16 include flat metal strips 12*a*, 14*a*, 16*a*, respectively, each formed of rigid conductive metal, preferably, copper or copper alloy. The metal strips have a substantially rectangular cross section and a thickness between about 0.010 and 0.040 inches. The metal strips have a multi-turn configuration in which a series of straight segments wind inwardly about an axis 20 of the winding elements. Metal strip 12*a* winds inwardly clockwise from a terminal 26 at an outer edge of winding 12 to an inner tab 28 (FIG. 4A). On the other hand, metal strip 14*a* —which is a mirror image of metal strip 12*a* —winds inwardly counterclockwise from a terminal 31 at an outer edge of winding 14 to an inner tab 30 (FIG. 4C). Metal strips 12*a* and 14*a* are identical in all other respects.

Metal strips 12*a*, 14*a*, 16*a* are individually encapsulated between a pair of insulative sheets 22 having a thickness between about 0.0005 and 0.001 inches. Preferably, a polyimide film having a thermally bondable acrylic adhesive coating is used to insulate the metal strips. Pyralux®, Kapton® polyimide film, a product of E.I Dupont de Nemours & Co., Wilmington, Del., is particularly well suited for encapsulating the metal strips to ensure a moisture impervious seal. For reasons which will be discussed in greater detail below, insulative sheets 22 include pre-formed holes 24 for allowing the winding elements 12, 14 to be electrically interconnected. Note that although the winding elements 12, 14, 16 are shown to be relatively thin in FIG. 2, in reality, they are much thicker as more accurately depicted in the cross-sectional views of FIGS. 3 and 6A.

Metal strips 12*a* and 14*a* provide a multi-turn winding, each having, in this embodiment, two turns so that when the metal strips are connected together, a four turn-primary winding is provided. Metal strip 16*a* of secondary winding 16, on the other hand, has only a single turn extending between terminals 32 positioned at an edge of the winding. Thus, in this embodiment, the assembled transformer of FIG. 1, has a 4:1 turns ratio. In operation, for example, a nominal 48 volt input which is supplied at terminals 26, 31 provides a highly-regulated 12 volt output (30 Amperes) at terminals 32 of secondary winding 16.

Figure 1:
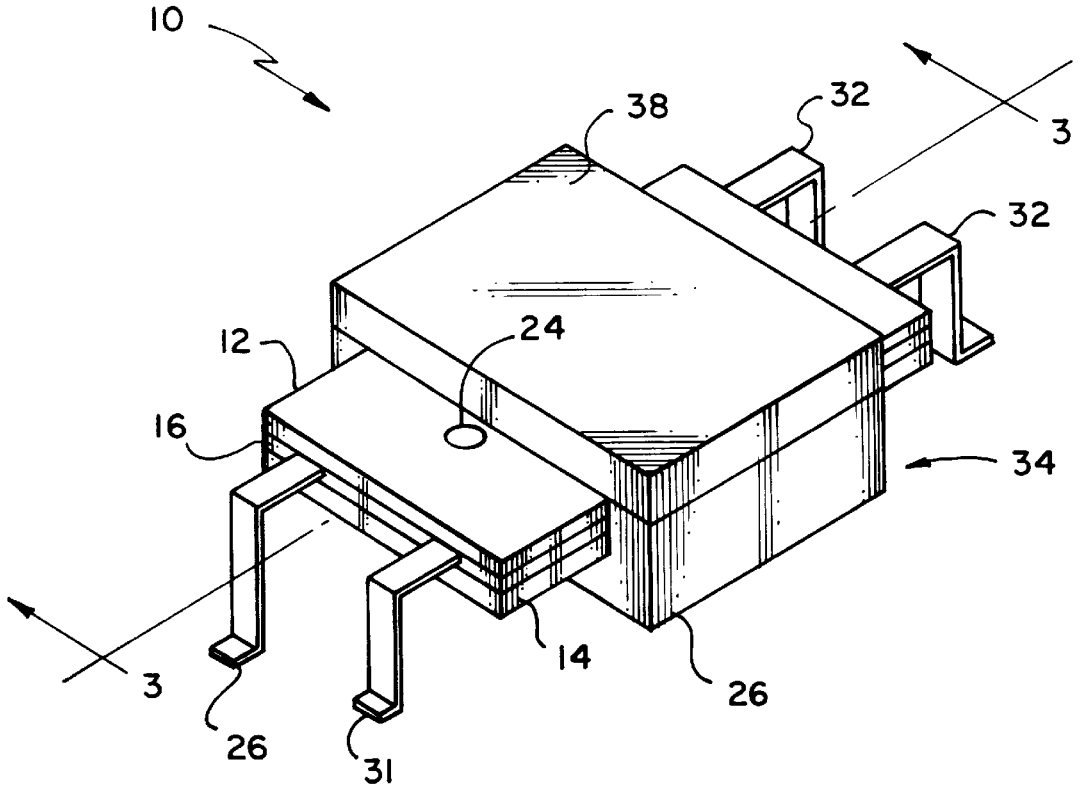
FIG. 1 is a perspective view of a planar transformer of the invention.
Figure 2:
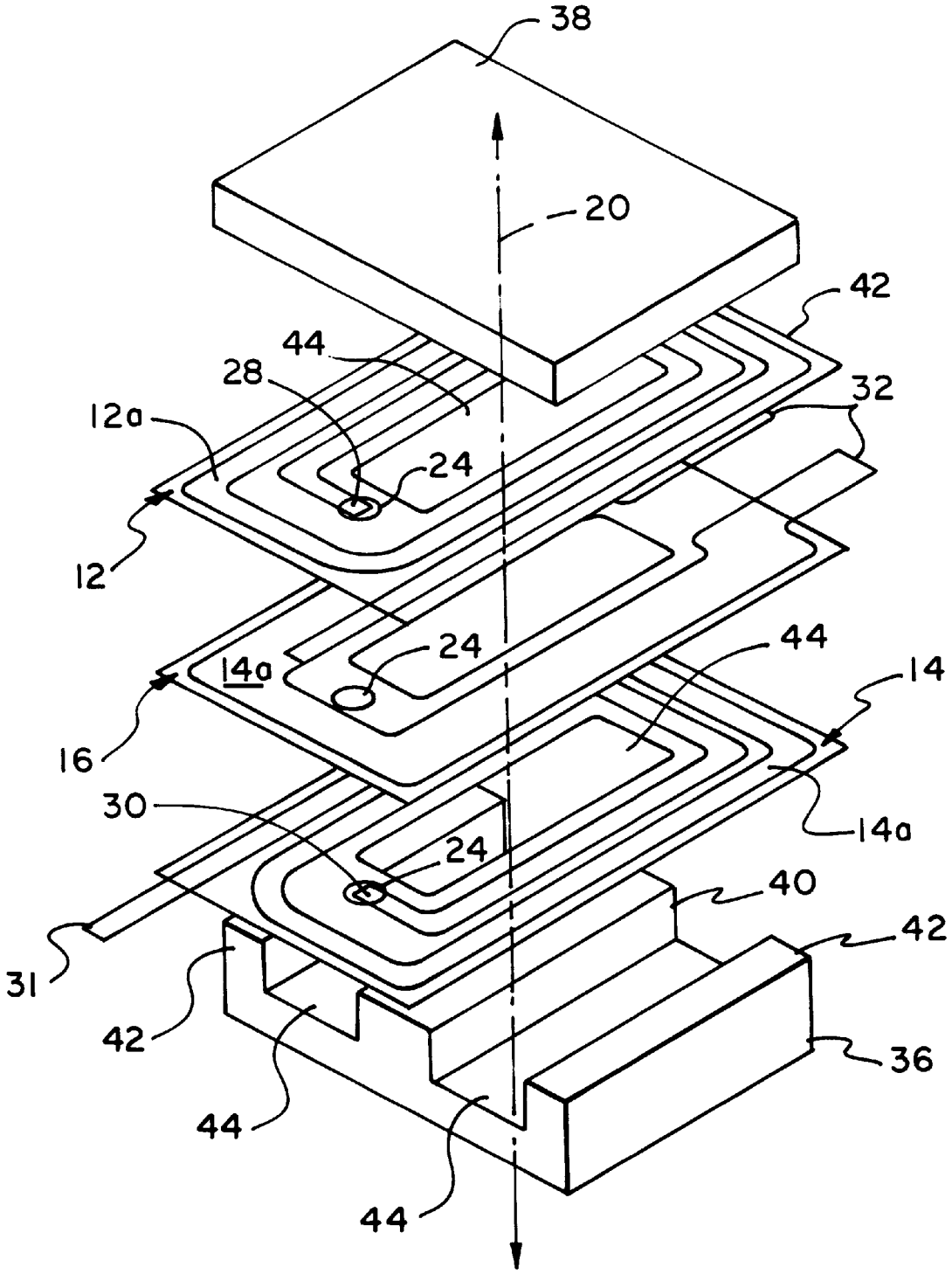
FIG. 2 is an exploded view of the planar transformer of FIG. 1.
Figure 3:
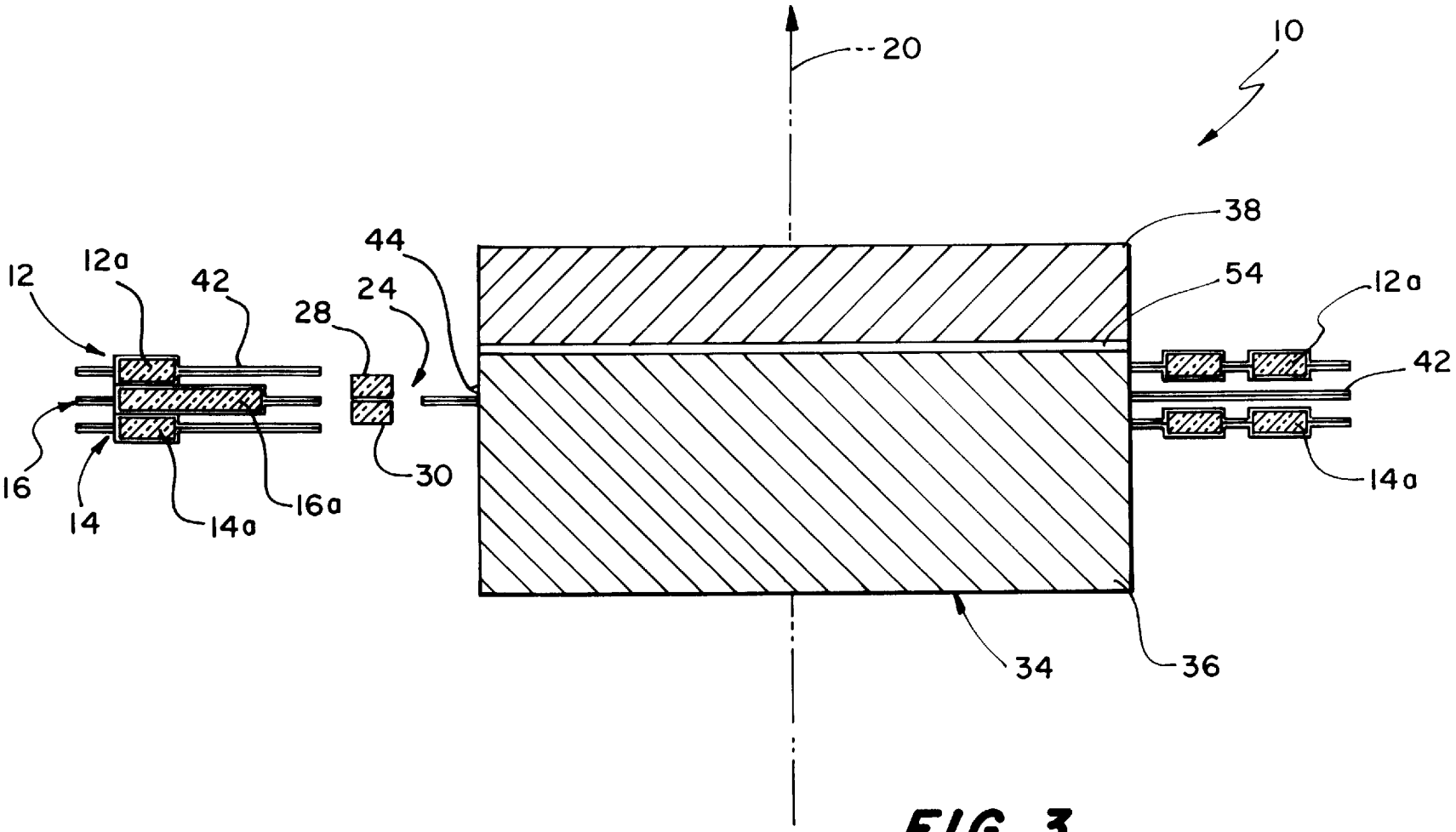
FIG. 3 is a cross-sectional side view of the transformer along lines 3—3 of FIG. 1.

Primary current, introduced at terminal 26 of metal strip 12*a*, flows through metal strip 12*a* and to metal strip 14*a* via the interconnection of inner tabs 28, 30 of the metal strips. The primary current continues to flow through metal strip 14*a* to a terminal 31. The primary current flowing through windings 12 and 14 generates a magnetic field which is coupled to secondary winding element 16 to produce the stepped-up (or stepped-down) voltage at terminals 32. As shown in FIG. 1, terminals 26, 31, 32 are bent to allow attachment to surface mounted holes of a printed circuit board.

To provide a more efficient magnetic circuit, the winding elements 12, 14, 16 are mounted within a transformer core assembly 34 having an E-core member 36 and a top plate 38 both of which are formed of a sintered ferrite material, and together provide a flux path for the magnetic field generated by the winding elements. E-core member includes a center post 40 and a pair of end posts 42 which together define a pair of channels 44 within which the winding elements are positioned. The insulative sheets 22 of winding elements 12, 14, 16 include rectangularly-shaped openings 44 through which the center post extends. Thus, center post 40 facilitates registration of the winding elements within the core assembly.

Unlike secondary winding 16 which has only a single turn and has its connections along its periphery, windings 12, 14 are multi-turn and require a connection of the windings at a point internal to the turns of the windings. The interconnection of inner tabs 28 and 30 of windings 12, 14 is made possible by the pre-formed holes 24 provided within insulative sheets 22 of windings 12, 14, 16. In particular, inner tabs 28, 30 project within the holes formed within its encapsulating insulative sheet and are positioned one above the other.

Referring again to FIGS. 4A–4C, the winding turns of the metal strip conductors 12*a*, 14*a*, 16*a* include segments generally joined at right angles to each other. The junction of these segments may be in the form of bends having a predetermined radius of curvature to improve the magnetic characteristics of the winding and to provide a more effective seal over the relatively thick metal strip.

Figure 5:
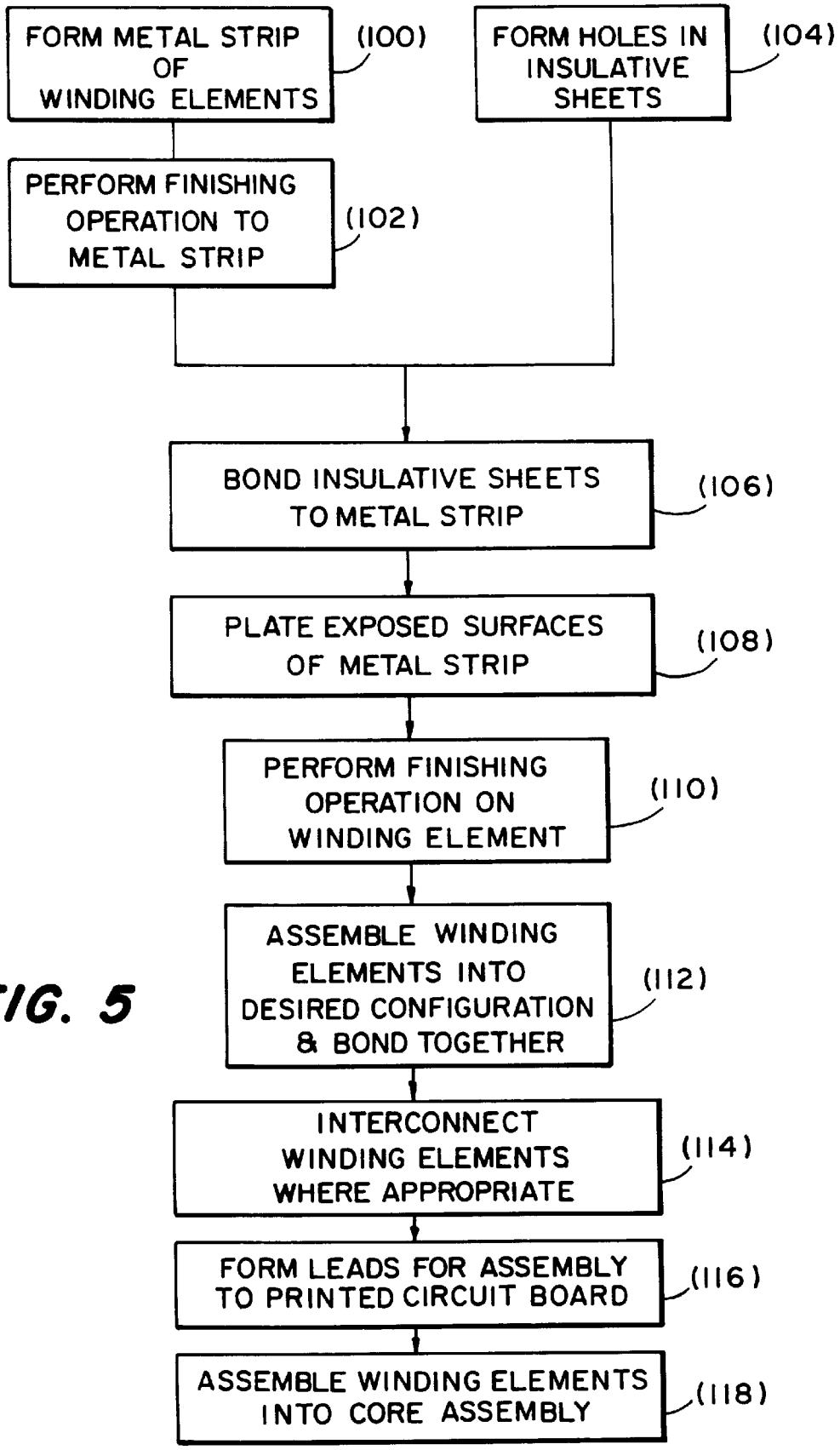
FIG. 5 is a flow diagram illustrating an approach for fabricating the planar transformer of FIG. 1.
Figure 10:
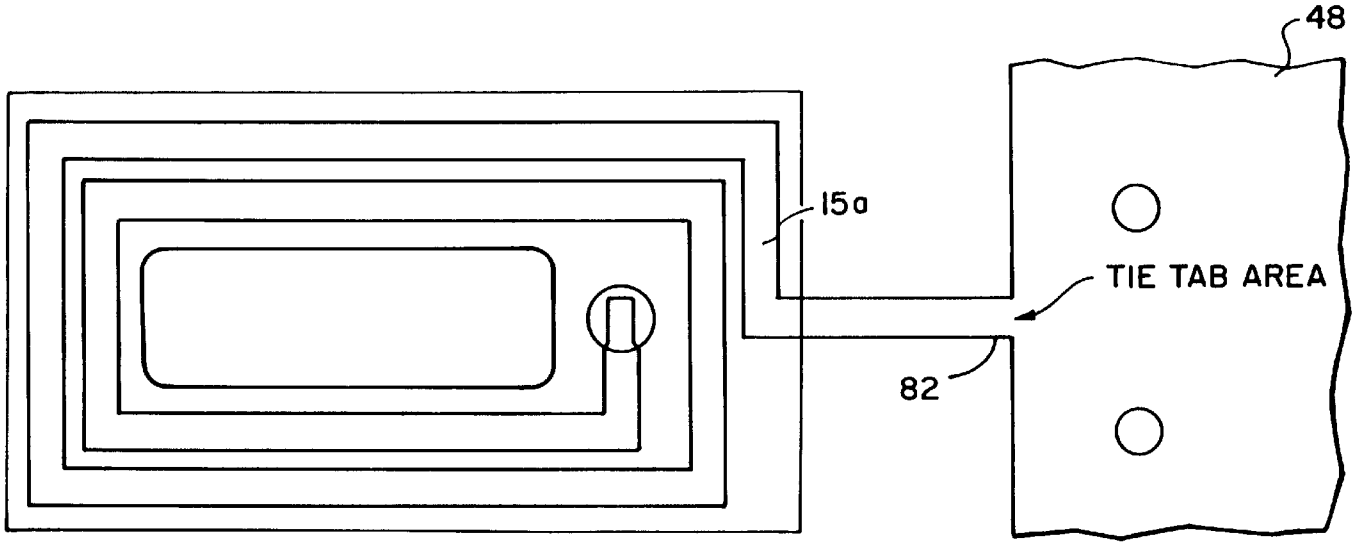
FIG. 10 is a plan view of a winding element of the transformer of FIG. 9.

With reference to the flowchart of FIG. 5, a preferred approach for assembling a planar transformer of the type shown in FIGS. 1–3 and 4*a*–4*c* is described. To provide a more efficient manufacturing process, each of the winding elements 12, 14, 16 are generally fabricated on a lead frame strip 48 (FIG. 10). For example, as many as six of each of the winding elements 12 may be attached to an individual lead frame strip.

Metal strips 12*a*, 14*a* and 16*a* are preferably formed by a stamping or photochemical etching process (step 100). In the development of prototype designs, the metal strips may, alternatively, be formed with a wire electronic discharge machining (EDM) process. Depending on the particular process used to form the metal strips, various finishing operations may be required (step 102). For example, following stamping and cleaning of the metal strips, a coining process may be used to remove burrs from the edges of the strips. A microetching step may also be performed after coining in preparation of a plating operation.

In a process separate from that of preparing the metal strips, the adhesively-clad insulator sheets 22 are cut into strips and are provided with holes 24 (e.g., pre-punched or pre-drilled) (step 104). The holes are about 0.100 inches in diameter and may be formed in both of the insulative sheets or simply the insulative sheet which faces the winding to which the metal strip connects. The insulative sheets are positioned on both sides of the metal strip within an assembly fixture (not shown) with the adhesive backing of the sheets in contact with the metal strip. With respect to metal strips 12*a*, 14*a* which correspond to the primary winding of transformer 10, the metal sheets are aligned with holes 24 overlying end tabs 28, 30 of the metal strips so that the tabs project into and are exposed by the holes. The metal strip is then thermally bonded within the insulative sheets by applying heat and pressure to the insulative sheets using a differential pressure lamination apparatus (step 106). A differential pressure lamination apparatus provides a vacuum to eliminate any air between the insulative sheets, thereby ensuring an effective seal. Conformal press pads may be used to apply the pressure to the winding structure. The levels of pressure and heat applied to the insulative sheets and metal strips during the sealing process are determined empirically depending on a number of factors, including the number of units being processed at a given time. In most applications, however, the applied temperature is generally as high as 190° C. and the pressure levels are as high as 500 psi. These temperature and pressure levels are applied for about 1.5 hours (at temperature). Such extreme pressure and temperature levels are required to ensure the moisture impervious seal between the relatively thick metal strips (e.g., 40 mils) and relatively thin insulative sheets (e.g., 2 mils). Guaranteeing such a seal is important because corrosive effects are augmented at the high temperatures which the transformers operate.

Figure 6A:
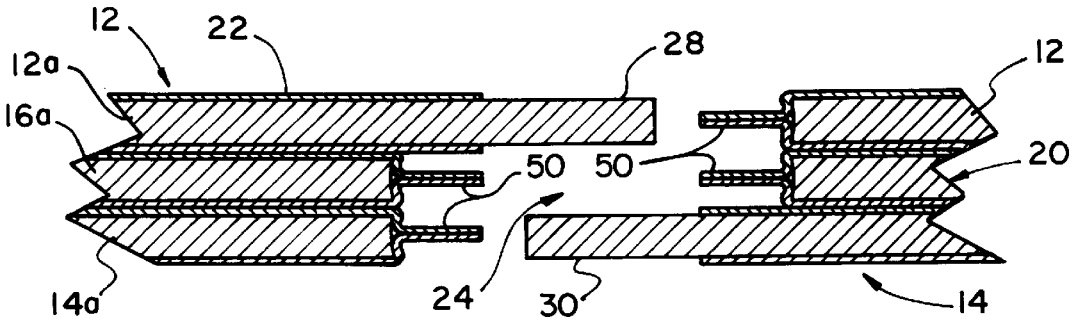
FIG. 6A and 6B are cross-sectional side views of a portion of the transformer of FIG. 1, prior to and after bending of the tab ends of the metal strips, respectively.

Referring to FIG. 6A, an exploded cross-sectional side view of the area region of holes 24 of the stacked arrangement of windings 12, 14, 16 is shown. It is important to note that in areas where a tab is not intended to extend from the insulative sheets, the sheets are cut or pre-punched to provide an insulative sheet region 50 which extends beyond the end of the metal strip which the sheets enclose. In this way, when the differential pressure lamination process is applied to the insulator sheets, the extended regions are "pursed" to provide a reliable seal of the metal strip. To ensure an effective seal between the thin insulative sheets and the thick metal strips, the length of region 50 is generally desired to be 1.5 to 2 times the thickness of the metal strip. For example, for a 40 mil thick metal strip, the length of region 50 should be between 60 and 80 mils long.

After cooling, the exposed surfaces of the metal strip are tin-plated to prevent oxidation of the copper and to improve solderability to their surfaces (step 108). The exposed surfaces include inner tabs 28, 30 which project into their respective holes 24 as well as terminals 26, 30, 32 which extend from the periphery of the winding Although the metal strips may be plated prior to laminating the insulative sheets, it is preferable to do so afterwards. Plating after laminating allows the assembler to test the quality of the seal. Any leak in the laminated insulative sheets will result in "wicking" of the plating under the sheets and onto supposedly sealed surfaces of the metal strips. The assembler can, therefore, visually inspect for a defective seal by visually inspecting for plating on surfaces of the metal strip beneath the laminated insulative sheets.

After plating, edges of the laminated insulative sheets 42 are generally trimmed to finish the laminated winding element (step 110). At this stage of assembly, additional openings (e.g., rectangularly-shaped openings 44) may be punched through the insulative sheets to accommodate, for example, the center post 40 of the core assembly 34.

Figure 6B:
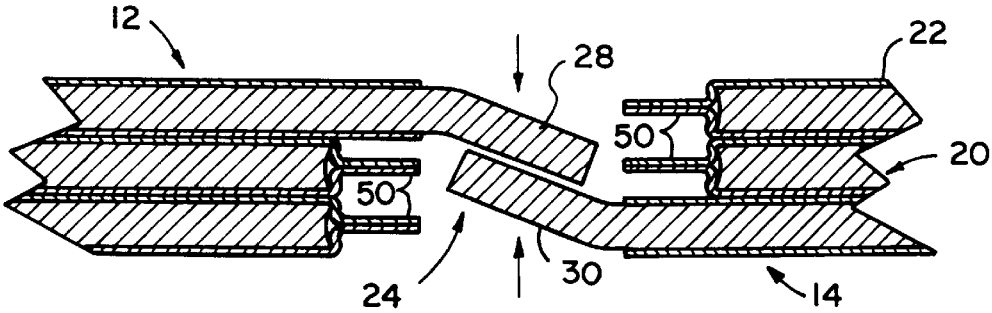

Referring to FIG. 6B, to electrically interconnect tab ends 28, 30 of winding elements 12 and 14, the winding elements are positioned within a fixture (not shown). The fixture has pins which are directed from either side of the assembly and bend the tab ends 28, 30 in a direction toward each other (indicated by arrows) causing them to contact each other in a region of the pre-formed hole 44 in insulative sheet 22 of secondary winding element 16. As shown more clearly in FIGS. 4A and 4C, tabs 28, 30 may be formed to have a width less than their associated metal strips 12*a*, 14*a* to facilitate their interconnection.

Figure 7:
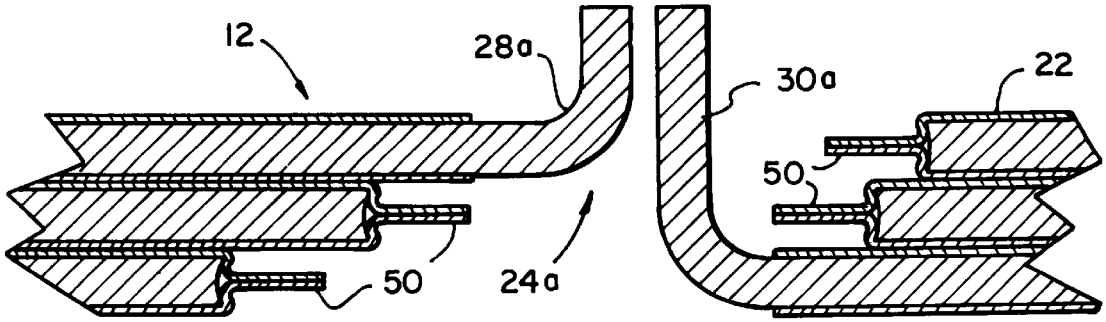
FIG. 7 is a cross-sectional side view of a portion of an alternate embodiment of the transformer of FIG. 1 after bending of the tab ends of the metal strips.
Figure 8A:
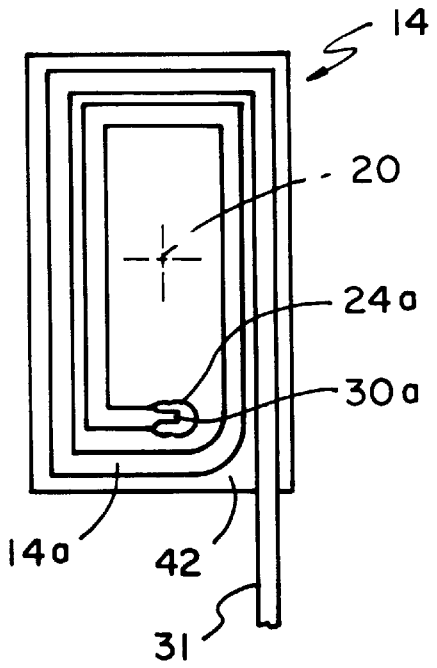
FIG. 8A and 8B are plan views of the winding elements of FIG. 7.
Figure 8B:
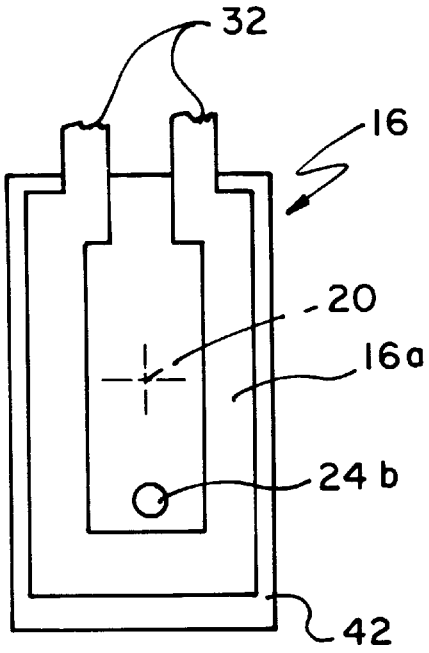

Referring to FIGS. 7, 8A and 8B, in an alternate embodiment, metal strip 14*a* of winding element 14 includes an inner tab 26*a* which is longer than an inner tab 30*a* associated with metal strip 12*a* of winding element 12. However, unlike the embodiment discussed above in conjunction with FIGS., 6A and 6B, tabs 28*a* and 30*a* are both bent in the same direction (here upward) so as to extend out of holes 24*a* where they are easily soldered together. This arrangement facilitates visual inspection and testing of the solder joint. Moreover, having tabs 28*a* and 30*a* extend out of hole 24 is better suited for applications in which the tabs are soldered using a commercial wave soldering machine or a drag soldering system.

In this embodiment, holes 24*a* are preformed to be elongated and larger than holes 24 of FIGS. 4A and 4C. Holes 24*a* are larger to accommodate the longer tabs of 30*a* which must extend through windings 12 and 16. Moreover, the larger holes may be desirable in applications where the high levels of pressure applied during the lamination of insulative sheets 22 causes the adhesive backing to be drawn into the hole, thereby shrinking its size. Moreover, because tabs 28*a* and 30*a* are connected outside the hole rather than in the region of the hole in secondary winding 16, hole 24*b* of secondary winding 16 may be made smaller. The smaller hole 24*b* allows metal strip 16*a* to be made slightly smaller, thereby decreasing the overall dimensions of the transformer.

The assembled windings are then arranged in any of variety of stacked configurations and are bonded together with an adhesive, such as a thermally curable epoxy (step 112). It is important to note that because the windings are individually sealed (as described above in connection with step 106) this secondary bonding step need not be relied upon to provide a moisture impervious seal of the windings. Solder paste or a preform is then applied to the contacting tab ends and is melted using a reflow oven (step 114). Alternatively, as mentioned above, the windings may be conveyed through a commercial wave soldering machine or a drag soldering system.

The assembled winding elements are then removed from the lead frame strips and terminals 26, 30, 32 are generally bent to allow attachment to surface mounted holes of a printed circuit board (step 116). Alternatively, pins or other terminal elements may be attached to the external and inner end tabs to allow connection to the printed circuit board.

The adhesively-bonded windings may then be assembled within a ferrite core assembly (step 118). For example, in the transformer arrangement shown in FIG. 2, windings 12, 14 and 16 are mounted within E-core member 36 of the core assembly. Top plate 38 is then adhesively attached to E-core member thereby securing the winding elements within the core assembly. In some embodiments, center post 40 may contact the top plate, while in others, the center post is spaced by a gap 54 (FIG. 3) which is selected to control the flux density of the magnetic circuit.

Figure 9:
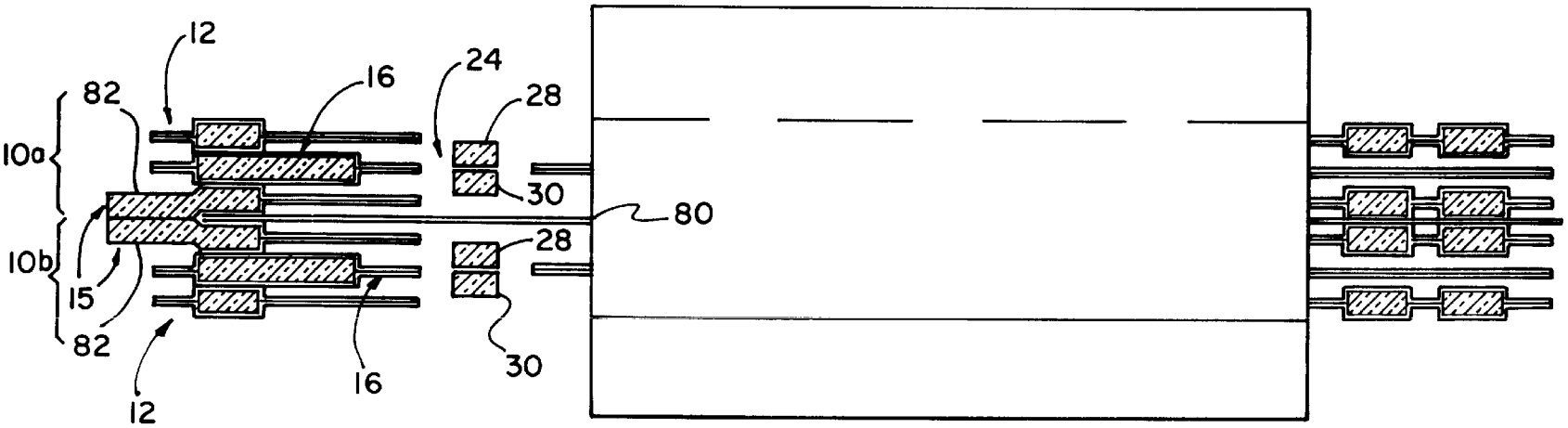
FIG. 9 is a cross-sectional side view of an alternate embodiment of a transformer.

The stacked arrangements of winding assemblies may be combined in any number of different ways to provide transformers having different characteristics. For example, as mentioned above, the transformer 10 described above in conjunction with FIGS. 1–4 is designed to have a 4:1 turns-ratio. Electrically interconnecting different combinations of this transformer may provide a transformer with different characteristics. Referring to FIG. 9, for example, a cross-sectional view of a pair of transformers, each similar to that described above, are shown stacked one above the other and electrically connected together. This configuration is well suited for applications requiring increased efficiency and a lower output voltage. For ease of understanding, reference numerals identifying the same elements of the transformer of FIG. 1 are used. Thus, in essence, the uppermost transformer assembly 10*a* includes a secondary winding positioned between a pair of winding elements 12, 15 which together form the primary winding of the transformer. Winding elements 12 and 15 are electrically connected by soldering inner tabs 28, 30 at hole 44. Lowermost transformer lob is a mirror image of transformer 10*a* and is separated from transformer 10*a* by an insulative polyimide sheet 80 which serves as a barrier between transformers 10*a* and 10*b*.

Referring to FIG. 10, winding 15 is identical to winding 14 of FIGS. 1–4 except that external terminal element 82 extends from the center of the winding rather than along an outer edge of winding 14. Providing terminal element 82 at the center of the winding results in the terminal elements 82 overlying each other so that they can be easily interconnected by soldering.

Other embodiments are within the following claims. For example, the concept of the invention is applicable to other magnetic coil components including inductors.

What is claimed is:

1. A planar winding assembly comprising:

first and second windings, each winding having an axis and including:

a pair of insulative sheet layers, the layers being laminated together, at least one of each of the pairs of insulative sheets having a hole; and a metal strip conductor sealed between the laminated insulative sheet layers and having a portion projecting into the hole, the metal strip conductor wound about the axis of its winding;

the metal strip conductor of the first winding electrically connected to the metal strip conductor of the second winding through the holes of the insulative sheets.

2. The planar winding assembly of claim 1 wherein the first winding is a multiple turn winding.

3. The planar winding assembly of claim 1 wherein the metal strip conductors of the first and second windings are soldered together.

4. The planar winding assembly of claim 1 further comprising a third winding having a metal strip conductor, the third winding disposed between the first and second windings, the first and second windings interconnected to provide a primary of a planar transformer, the third winding providing a secondary of the transformer.

5. The planar winding assembly of claim 4, further comprising:

a pair of insulative sheet layers that are laminated together and seal the third winding; and at least one of the pair of insulated sheet layers having a hole through which the metal strip conductor of the first winding connects to the metal strip conductor of the second winding.

6. The planar winding assembly of claim 4 wherein the first, second and third windings are bonded together.

7. The planar winding assembly of claim 1 further comprising a ferrite core member, the insulative sheet members of the first and second windings having an aperture sized to receive the ferrite core member.

8. The planar winding assembly of claim 4 wherein each of the insulative sheet members of the first, second and third windings have an aperture sized to receive a ferrite core member.

9. The planar winding assembly of claim 1 wherein each of the metal strip conductors are formed on a lead frame element.

10. The planar winding assembly of claim 1 wherein the insulative sheet members are polyimide.

11. The planar winding assembly of claim 1 wherein each of the metal strip conductors are copper.

12. The planar winding assembly of claim 1, wherein the metal strip conductor of the first winding is about 0.040 inches thick and the insulative sheets of the first winding are about 0.002 inches thick.

13. The planar winding assembly of claim 1, wherein the metal strip conductor of the first winding has a thickness in the range between about 0.010 inches and about 0.040 inches.

14. The planar winding assembly of claim 1, wherein the insulative sheets of the first winding have a thickness between about 0.0005 inches and about 0.001 inches.

15. The planar winding assembly of claim 1, wherein the insulative sheets of the first winding are laminated to form a seal impervious to moisture.

16. The planar winding assembly of claim 1, wherein the tabs have a width less than or equal to the width of the respective metal strip conductors.

* * * * *